US008157131B2

(12) United States Patent
Sim

(10) Patent No.: US 8,157,131 B2
(45) Date of Patent: Apr. 17, 2012

(54) SPRAY BOTTLE WITH REFILL CARTRIDGE

(76) Inventor: Jae K. Sim, Rancho Cucamonga, CA (US)

( * ) Notice: Subject to any disclaimer, the term of this patent is extended or adjusted under 35 U.S.C. 154(b) by 582 days.

(21) Appl. No.: 12/270,735

(22) Filed: Nov. 13, 2008

(65) Prior Publication Data

US 2010/0084368 A1 Apr. 8, 2010

Related U.S. Application Data

(60) Provisional application No. 61/102,734, filed on Oct. 3, 2008.

(51) Int. Cl.
*B65D 23/12* (2006.01)

(52) U.S. Cl. ..... 222/129; 222/136; 222/382; 222/383.1; 215/386

(58) Field of Classification Search ..... 222/129, 222/136, 321.1, 321.7, 321.8, 325, 382, 383.1, 222/464.1; 206/219; 215/386
See application file for complete search history.

(56) References Cited

U.S. PATENT DOCUMENTS

| | | | |
|---|---|---|---|
| 2,642,065 | A | 4/1951 | Negri |
| 3,024,947 | A | 3/1962 | Jeynes, Jr. et al. |
| 3,080,094 | A | 3/1963 | Modderno |
| 3,134,505 | A | 5/1964 | Modderno |
| 3,172,568 | A | 3/1965 | Modderno |
| 3,221,946 | A | 12/1965 | Riley |
| 3,240,391 | A | 3/1966 | Garton |
| 3,240,403 | A | 3/1966 | Modderno |
| 3,255,924 | A | 6/1966 | Modderno |
| 3,255,926 | A | 6/1966 | Modderno |
| 3,314,563 | A | 4/1967 | Mounier |
| 3,318,484 | A | 5/1967 | Modderno |
| 3,458,076 | A | 7/1969 | Babcock |
| 3,548,562 | A | 12/1970 | Schwattzman |
| 3,613,955 | A | 10/1971 | Wetherell, Jr. |
| 3,648,899 | A | 3/1972 | Lukesch et al. |
| 3,655,096 | A | 4/1972 | Easter |

(Continued)

FOREIGN PATENT DOCUMENTS

| | | |
|---|---|---|
| DE | 8101400 | 5/1981 |

(Continued)

OTHER PUBLICATIONS

Search Report and Written Opinion for PCT/US2009/058933.

*Primary Examiner* — Kevin P Shaver
*Assistant Examiner* — Donnell Long
(74) *Attorney, Agent, or Firm* — Stetina Brunda Garred & Brucker

(57) ABSTRACT

A refill cartridge disposable within a spray bottle during usage thereof. The refill cartridge includes a cartridge body defining a cartridge reservoir. The cartridge body includes first and second openings, the second opening being defined by a projection of the cartridge body. A cap is connected to the cartridge body to substantially cover the first opening. The cap includes a cap base having a primary opening. A cap boss is connected to and extends from the cap base and defines a passage concentrically aligned with the primary opening. The refill cartridge additionally includes a plug having a plug body including a plug neck and a flared portion, with the plug neck defining a distal end. The plug is engageable with the cap and the cartridge body and is moveable relative to the cap and cartridge body between a sealing position and a dispensing position.

11 Claims, 5 Drawing Sheets

U.S. PATENT DOCUMENTS

| | | | |
|---|---|---|---|
| 3,891,125 | A | 6/1975 | Morane et al. |
| 4,121,772 | A | 10/1978 | Cronan et al. |
| 4,221,291 | A | 9/1980 | Hunt |
| 4,613,061 | A | 9/1986 | Meuresch et al. |
| 4,705,191 | A | 11/1987 | Itzel et al. |
| 4,757,916 | A | 7/1988 | Goncalves |
| 4,950,237 | A | 8/1990 | Henault et al. |
| 5,246,142 | A | 9/1993 | DiPalma |
| 5,273,189 | A | 12/1993 | Jouillat |
| 5,348,060 | A | 9/1994 | Futagawa et al. |
| 5,421,483 | A | 6/1995 | Parise |
| 5,645,193 | A | 7/1997 | Gentile et al. |
| 5,875,888 | A | 3/1999 | Albisetti |
| 5,927,549 | A | 7/1999 | Wood |
| 5,944,223 | A | 8/1999 | Klima et al. |
| 5,957,335 | A | 9/1999 | Otto |
| 5,992,693 | A | 11/1999 | Albisetti |
| 6,041,969 | A | 3/2000 | Parise |
| 6,053,371 | A | 4/2000 | Durliat |
| 6,152,326 | A | 11/2000 | Klima, Jr. et al. |
| 6,155,459 | A | 12/2000 | Bunschoten |
| 6,182,865 | B1 | 2/2001 | Bunschoten |
| 6,290,100 | B1 | 9/2001 | Yacko et al. |
| 6,360,918 | B1 | 3/2002 | Butler |
| 6,997,351 | B2 * | 2/2006 | Cho ..... 222/82 |
| 7,066,354 | B2 | 6/2006 | Stank |
| 7,331,486 | B2 | 2/2008 | Mon |
| 2007/0228074 | A1 | 10/2007 | Mueller et al. |
| 2009/0139882 | A1 | 6/2009 | DeJonge |

FOREIGN PATENT DOCUMENTS

| | | |
|---|---|---|
| DE | 3535986 | 4/1987 |
| EP | 101594 | 2/1984 |
| EP | 173547 | 3/1986 |
| EP | 333541 | 9/1989 |
| EP | 341115 | 11/1989 |
| FR | 2239390 | 2/1975 |
| GB | 2220930 | 1/1990 |
| IT | 1188018 | 12/1987 |

* cited by examiner

SPRAY BOTTLE WITH REFILL CARTRIDGE

CROSS-REFERENCE TO RELATED APPLICATIONS

This application claims the benefit of U.S. Provisional Application No. 61/102,734, filed on Oct. 3, 2008 and entitled SPRAY BOTTLE WITH REFILL CARTRIDGE.

STATEMENT RE: FEDERALLY SPONSORED RESEARCH/DEVELOPMENT (Not Applicable)

BACKGROUND OF THE INVENTION

1. Field of the Invention

The present invention relates generally to a refill cartridge for a spray bottle, and more particularly to an easy to use refill cartridge configured to be disposed within the spray bottle during usage thereof.

2. Description of the Related Art

It is well known in the art to employ the use of a spray bottle to dispense a fluid. For instance, cleaners, cosmetics, and other fluids are commonly sold in spray bottles to facilitate dispensing by a user. After repeated use of the spray bottle, the amount of liquid in the bottle decreases to the point where the spray bottle is effectively empty.

Once the spray bottle is empty, many users are inclined to throw the empty spray bottle away and purchase a new spray bottle, despite the fact that the empty spray bottle is still capable of dispensing fluid. Given that a typical spray bottle is generally designed to hold a small amount of fluid (i.e., one quart), a user may quickly consume all of the fluid contained within the spray bottle. As such, a large number of spray bottles may be used over a short period of time.

Many spray bottles are formed out of a environmentally harmful materials, such as plastics. Therefore, large consumption of such spray bottles may have detrimental effects on the environment.

As an alternative to buying a new spray bottle upon emptying a previous spray bottle, a user can often times purchase a refill which usually contains a smaller amount of the fluid in a higher concentration. The fluid in the refill can be poured into the spray bottle and mixed with water or other diluting fluids to fill the spray bottle. Purchasing a refill tends to be more environmentally friendly, as the refill container is typically smaller than the original spray bottle container. Furthermore, the refill tends to be less expensive than purchasing a new spray bottle.

Although purchasing a refill offers certain advantages, many consumers are more likely to purchase a brand new spray bottle rather than purchase a refill. In this manner, many consumers have a habit of throwing away a spray bottle when it is empty rather than storing an empty spray bottle until they can buy a refill. Once the consumer throws the empty spray bottle away, there are precluded from purchasing a refill. Furthermore, when refills are sold on a shelf next to a full spray bottle, consumers may be inclined to purchase the new spray bottle rather than the refill.

As is apparent from the foregoing, there exists a need in the art for a new spray bottle refill, and a method of distributing the refill with the spray bottle. The present invention addresses this particular need, as will be discussed in more detail below.

BRIEF SUMMARY OF THE INVENTION

According to an aspect of the present invention there is provided a refill cartridge which may be disposed within a spray bottle during usage of the spray bottle. The refill cartridge includes a cartridge body defining a cartridge reservoir. The cartridge body includes a first opening and a second opening which is defined by a projection of the cartridge body. The refill cartridge further includes a cap connected to the cartridge body to substantially cover the first opening. The cap includes a cap base having a primary opening. A cap boss is connected to and extends from the cap base. The cap boss defines a passage concentrically aligned with the primary opening. The refill cartridge additionally includes a plug having a plug body including a plug neck and a flared portion, with the plug neck defining a distal end. The plug is engageable with the cap and the cartridge body and is moveable relative to the cap and cartridge body between a sealing position and a dispensing position. In the sealing position, the plug neck is frictionally engaged with the cap boss, with the distal end of the plug protruding through the primary opening beyond the cap base. Additionally, the flared portion of the plug is frictionally engaged with the projection of the cartridge body to form a fluid tight seal therebetween. In the dispensing position, the flared portion is moved from fluid tight engagement with the projection of the cartridge body.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings in which like numbers refer to like parts throughout and in which.

DETAILED DESCRIPTION OF THE INVENTION

Figure 1:
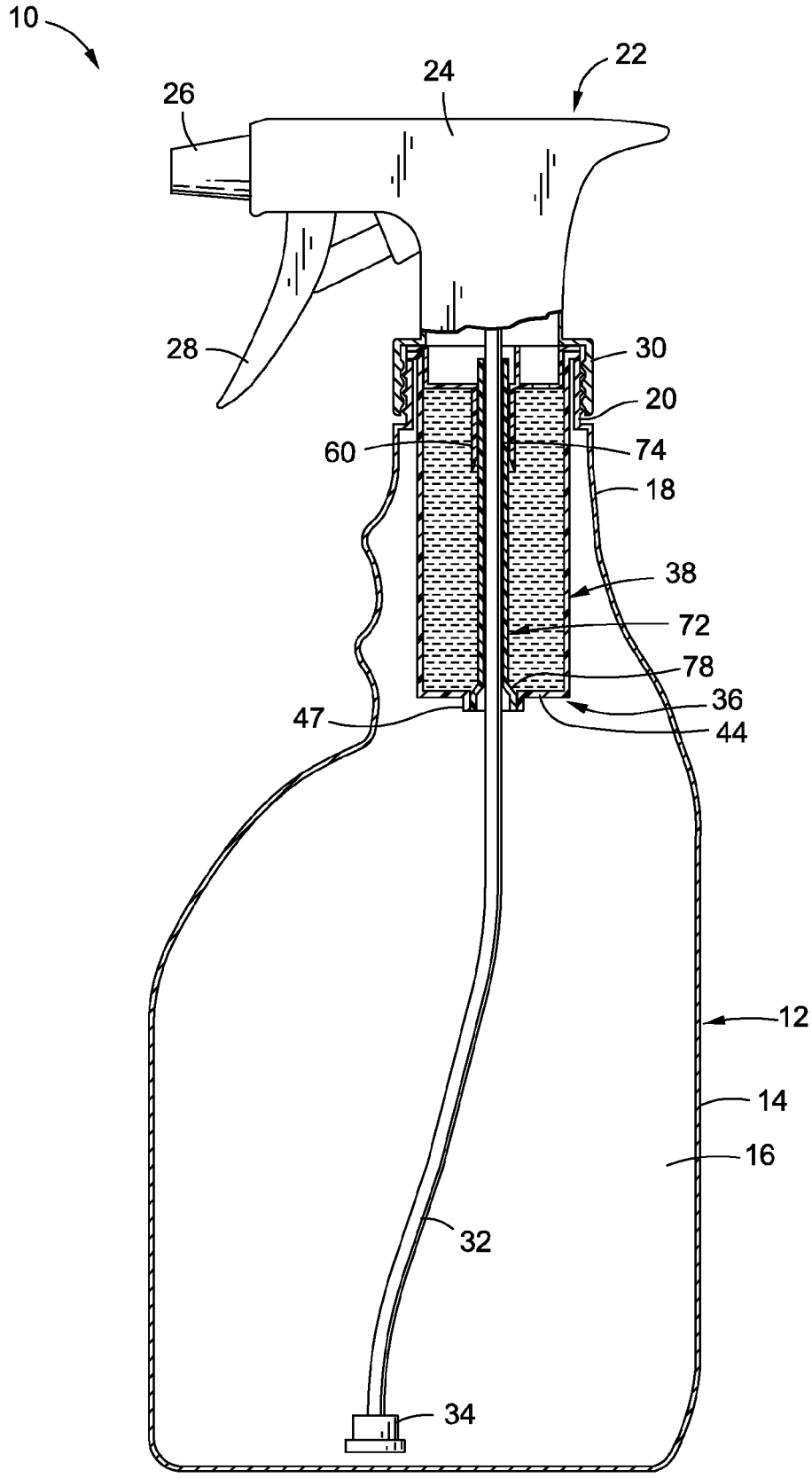
FIG. 1 is a side sectional view of a spray bottle assembly constructed in accordance with an embodiment of the present invention, the spray bottle assembly including a bottle, a pumping mechanism, and a refill cartridge having a cartridge body, a cap, and a plug.
Figure 2:
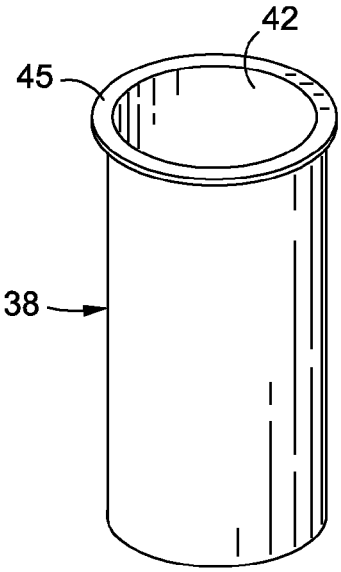
FIG. 2 is a top perspective view of the cartridge body of the refill cartridge.
Figure 3:
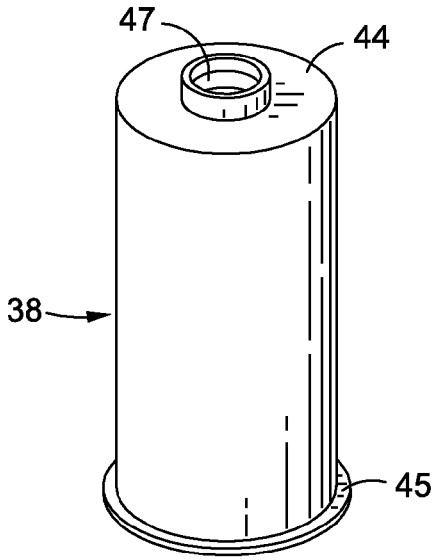
FIG. 3 is a top perspective view of the cartridge body illustrated in FIG. 2, the cartridge body being rotated 180 degrees.
Figure 4:
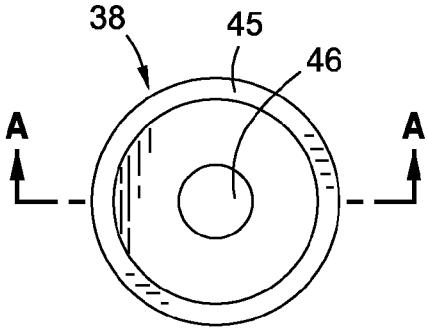
FIG. 4 is a top plan view of the cartridge body.

Referring now to the drawings wherein the showings are for purposes of illustrating a preferred embodiment of the present invention only, and not for purposes of limiting the same, FIGS. 1-13 illustrate a spray bottle assembly 10 constructed in accordance with an embodiment of the present invention. The spray bottle assembly 10 may be used to easily dispense fluids, such as cleaning fluids, detergents, cosmetic fluids, perfumes, or other fluids known in the art. As described in more detail below, the spray bottle assembly 10 includes a pumping mechanism 22, a bottle 12 and a refill cartridge 36 that is disposable within the bottle 12. It is contemplated that the refill cartridge 36 may be packaged within the bottle 12 for sale. The easy-to-use configuration of the refill cartridge 36 allows for simple refilling of the bottle 12, thereby extending the usage of the bottle 12, which provides environmental and economic advantages.

Referring specifically to FIG. 1, the spray bottle assembly 10 includes the pumping mechanism 22 that is engageable with the bottle 12. The pumping mechanism 22 includes a body 24 having a nozzle 26, a trigger 28, and a tube 32 connected thereto. The tube 32 defines a tube end 34 that is disposable within a fluid for purposes of dispensing the fluid through the nozzle 26. In this manner, the nozzle 26 is in fluid communication with the tube 32.

The trigger 28 is moveable relative to the body 24 to dispense fluid from the nozzle 26. More specifically, the trigger 28 is moveable between an extended position and a retracted position relative to the body 24. As the trigger 28 moves from the extended position toward the retracted position, fluid is communicated from the tube 32 to the nozzle 26. In one embodiment, the trigger 28 is biased towards the extended position. The biasing force may be provided by a spring or other biasing elements.

The nozzle 26 may be moveable relative to the body 24 to control the output of fluid therethrough. In particular, the nozzle 26 may be configured to dispense a fluid in a stream-like manner, or in a mist. In this regard, the nozzle 26 may rotate relative to the body 24 to modify the fluid output from a stream to a mist. The nozzle 26 may also be closed to restrict the passage of fluid therethrough.

According to one embodiment, the pumping mechanism 22 is attachable to the bottle 12 via a pump attachment element 30 that is sized and configured to engage with an engagement region 20 formed on the bottle 12 and defining a rim thereof. The engagement region 20 preferably comprises threads formed on the exterior of the neck portion 18 of the bottle 12. The tube 32 may extend into the interior of the bottle 12 (which is typically fluid-filled) when the pumping mechanism 22 is connected to the bottle 12. In the embodiment illustrated in FIG. 1, the attachment element 30 includes internal threads that engage with external threads of the engagement region 20 disposed on the neck portion 18 of the bottle 12. The internal threads engage with the external threads as the attachment element 30 is rotated or screwed onto the bottle 12. Although the embodiment illustrated in the drawings shows an attachment element 30 having internal threads, it is understood that other embodiments may include external threads that engage with internal threads formed in the bottle 12. Furthermore, it is contemplated that other embodiments of the attachment element 30 will not threadably engage with the bottle 12. For instance, various mechanical fasteners known in the art may be used to engage the pumping mechanism 22 to the bottle 12.

The bottle 12 includes a bottle wall 14 that is preferably formed out of a substantially fluid impermeable material, such as plastic, rubber, or other materials known in the art. The size and shape of the bottle 12 may vary. The bottle 12 depicted in FIG. 1 includes an ergonomic gripping portion configured to assist a user in grasping the bottle 12. The bottle wall 14 defines a reservoir 16 configured to receive a fluid, such as a cleaning fluid, or other fluids.

In operation, the pumping mechanism 22 is connected to a fluid filled bottle 12, with the tube 32 extending into the interior of the bottle 12. As a user repeatedly moves the trigger 28 from the extended position to the retracted position, the fluid contained within the bottle 12 is drawn in to the tube 32 via the tube end 34 and travels through the tube 32 and is dispensed out of the nozzle 26. The fluid level within the bottle 12 lowers as the fluid is dispensed through the nozzle 26. The bottle 12 may additionally include a secondary reservoir to facilitate dispensing of the fluid when the bottle 12 is tilted relative to a horizontal plane, as described in U.S. Provisional Application No. 61/097,827 entitled Spray Bottle with Primary and Secondary Internal Reservoirs, the entire contents of which are expressly incorporated herein by reference.

Referring now specifically to FIGS. 2-5, the refill cartridge 36 includes a cartridge body 38 defining a reservoir 40 configured to store fluid. In this manner, the cartridge body 38 is preferably formed of a fluid impermeable material, such as plastic or rubber. As depicted, the cartridge body 38 is substantially cylindrical in shape and extends along a longitudinal cartridge axis 48. In this manner, the cartridge body 38 is sized and configured to be disposed within the upper neck portion 18 of the bottle 12, as described in more detail below. Those skilled in the art will appreciate that the cartridge body 38 may define other non-cylindrical shapes and configurations.

The cartridge body 38 defines a first opening 42 and a second opening 46 at respective opposing ends of the cartridge body 38. The cartridge body 38 includes a flange 45 extending about the first opening 42. The flange 45 has an outer diameter that is greater than the diameter of the rim of the bottle 12 which defines a bottle opening thereof, as best shown in FIG. 1. In this manner, the refill cartridge 36 may be inserted within the bottle reservoir 16 with the flange 45 resting on the rim of the bottle 12 defined at the bottle opening thereof.

Figure 5:
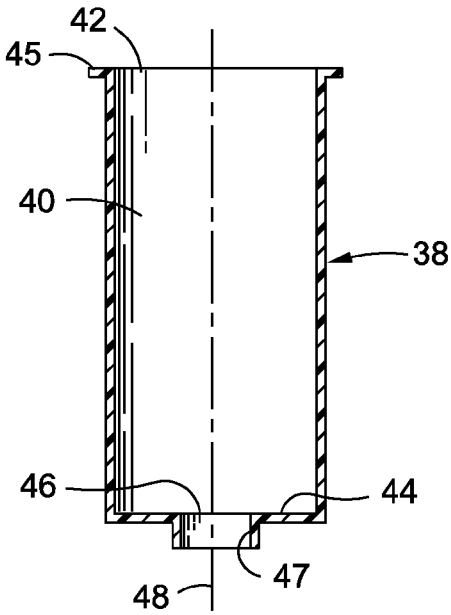
FIG. 5 is a side sectional view of the cartridge body depicted in FIG. 4.

As best shown in FIG. 5, the cartridge body 38 of the refill cartridge 36 also includes a bottom wall 44 having a ring-like projection 47 which protrudes from the approximate center thereof and defines the second opening 46. The projection 47 has an outer diameter that is smaller than the maximum outer diameter of the cartridge body 38. The first and second openings 42, 46 are coaxially aligned with each other along the cartridge axis 48. As described in more detail below, a plug 72 may be inserted into the ring opening 47 (as shown in FIG. 1) to provide a fluid tight seal between the plug 72 and the cartridge ring 44 to mitigate fluid flow through the ring opening 47.

Referring now to FIGS. 6-10, the refill cartridge 36 also includes a cap 50 that is engageable with the cartridge body 38 at the first opening 42 to substantially cover the first opening 42. The cap 50 includes a cap base 56 and a cap wall 52 extending upwardly from the cap base 56. A cap flange 54 may circumscribe and protrude radially from the upper end of the cap wall 52 (opposite the cap base 56). The cap base 56 includes a primary opening 62 formed therein. The cap wall 52 and the cap base 56 collectively define a cavity 58. As shown, the cap wall 52 is substantially cylindrical in shape, and is complimentary to the shape of the cartridge body 38. In this manner, the outer diameter of the cap wall 52 is slightly smaller than the inner diameter of the cartridge body 38 at the first opening 42 to allow the cap 50 to be partially advanced into the cartridge body 38 when engaged thereto.

The cap 50 also includes a tubular cap boss 60 extending axially downwardly from the cap base 56 along an axis 70. The cap boss 60 includes a tapered inner wall 64 defining a passage 61 that is coaxially aligned with the primary opening 62.

The cap 50 may be placed within the first opening 42 of the cartridge body 38 of the refill cartridge 36 to cover and enclose the first opening 42. In this manner, the cap flange 54 preferably abuts the flange 45. When the cap 50 is connected to the cartridge body 38, the cap axis 70 is preferably aligned with the cartridge axis 48. As a result, the cap axis 70 is coaxially aligned with the cartridge axis 48. Once the cap 50 is engaged with the cartridge body 38, the cap 50 may be sealed to the cartridge body 38. In this regard, the interface between the cap 50 and the cartridge body 38 may be a substantially fluid tight seal.

Figure 6:
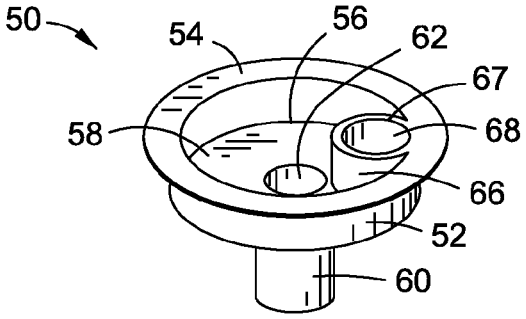
FIG. 6 is a top perspective view of the cap of the refill cartridge.
Figure 7:
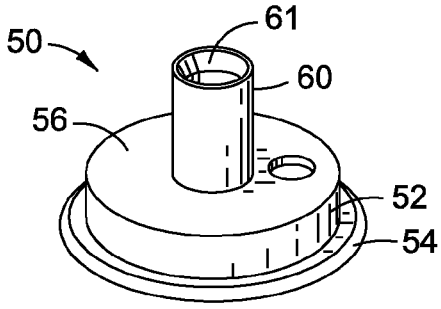
FIG. 7 is a top perspective view of the cap illustrated in FIG. 6, the cap being rotated 180 degrees.
Figure 8:
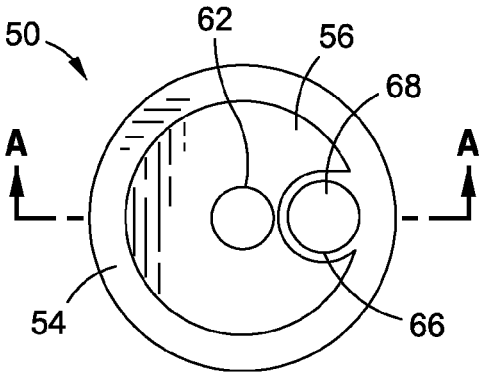
FIG. 8 is a top plan view of the cap.
Figure 9:
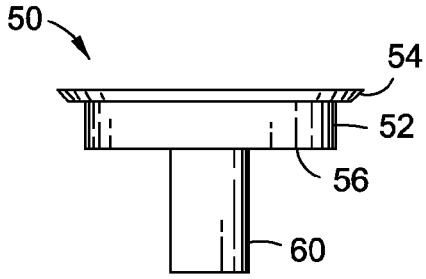
FIG. 9 is a side elevational view of the cap illustrated in FIG. 8.
Figure 10:
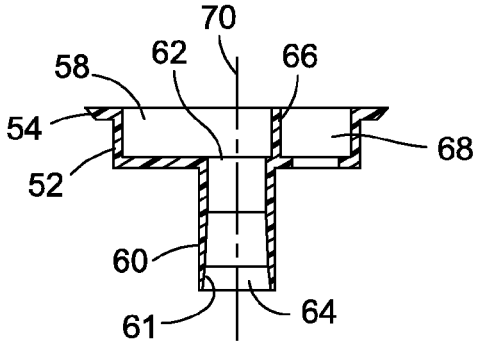
FIG. 10 is a cross-sectional view of the cap illustrated in FIG. 8.

According to one aspect of the present invention, the cap 50 also includes a ring-like projection 66 extending upwardly from the cap base 56 toward the cap flange 54. As shown in FIGS. 6 and 8, the projection 66 is offset from the center of the cap 50, with a portion of the projection 66 abutting the cap wall 52. However, it is understood that other embodiments of the cap 50 may include a projection 66 that does not abut the cap wall 52. The projection 66 includes an inner wall 67 defining a secondary opening 68 that extends through the cap base 56 and fluidly communicates with the reservoir 40 of the cartridge body 38. When the cap 50 is connected to the cartridge body 38, the refill cartridge 36 may be filled with a fluid via the secondary opening 68. Once the reservoir 40 is filled, it is contemplated that the secondary opening 68 will be sealed with a suitable plug.

Figure 12:
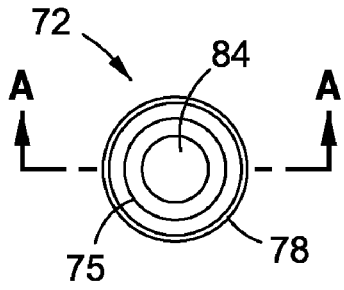
FIG. 12 is a top plan view of the plug.
Figure 11:
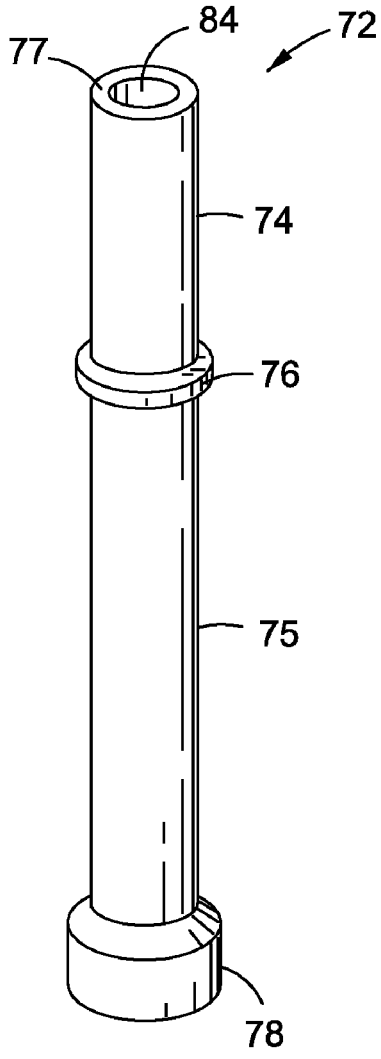
FIG. 11 is a top perspective view of the plug of the refill cartridge.
Figure 13:
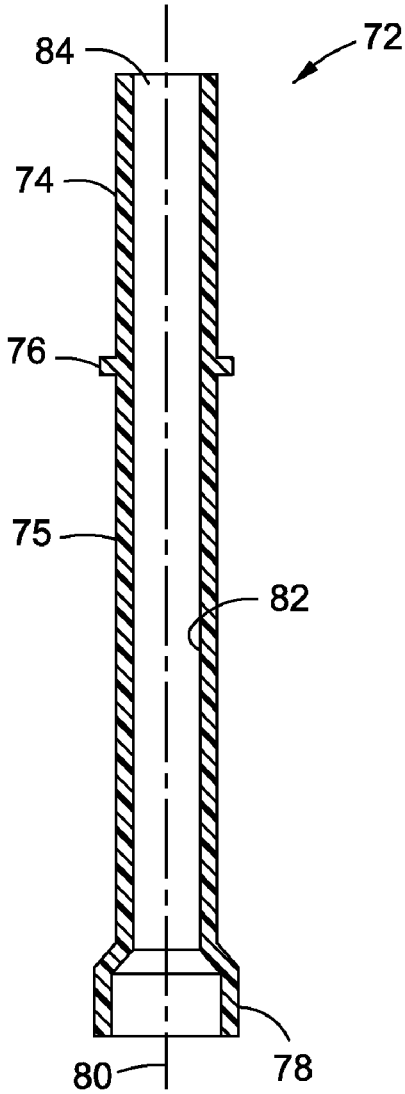
FIG. 13 is a cross-sectional view of the plug illustrated in FIG. 12.

Referring now to FIGS. 11-13, there is shown a plug 72 that is insertable into the cartridge body 38 to engage with the cartridge body 38 and the cap 50. The plug 72 includes a plug body 75 having a plug neck 74 defining a distal end 77. A plug flange 76 circumscribes the plug body 75 and extends radially outwardly therefrom. The plug 72 also includes a flared portion 78 having an outer diameter that is larger than the outer diameter of the plug body 75. The plug 72 further includes a plug inner wall 82 defining a flow passage 84 which extends along a plug axis 80. The diameter of the plug inner wall 82 is slightly larger than the outer diameter of the tube 32. In this manner, the tube 32 may be slidably advanced through the plug 72, and hence refill cartridge 36, as shown in FIG. 1.

The plug 72 is insertable into the cartridge body 38 via the second opening 46 for engagement with the cartridge body 38 and the cap 50. More specifically, the plug neck 74 and plug flange 76 are insertable through the second opening 48 to bring the plug neck 74 into frictional engagement with the cap boss 60, and to bring the flared portion 48 into concurrent frictional engagement with the projection 47 in the manner shown in FIG. 1. In this manner, the plug neck 74 and plug flange 76 are sized and configured to pass through the second opening 46, while the outer surface of the flared portion 48 is sized and configured to frictionally engage the inner surface of the projection 47. Similarly, the outer surface of the plug neck 74 is sized and configured to frictionally engage the inner wall 64 of the cap boss 60. The advancement of the plug neck 74 through the cap boss 60 may be limited by the abutment of the plug flange 76 against the distal end or rim defined by the plug boss 60. When the flared portion 78 is frictionally engaged to the projection 47 and the plug neck 74 frictionally engaged to the plug boss 60, the distal end 77 of the plug 74 typically resides within the cavity 58 of the cap 50, as also shown in FIG. 1.

The plug 72 is moveable relative to the cap 50 and the cartridge body 38 between a sealing position (shown in FIG. 1) and a dispensing position. In the sealing position, the plug neck 72 is engaged with a cap arm 60 via a friction type engagement. Furthermore, the flared portion 78 is frictionally engaged with the projection 47 to form a fluid tight seal therebetween. The fluid tight seal mitigates loss of fluid from the cartridge reservoir 40 through the second opening 46. When the plug 72 is in the sealing position, the plug flange 76 is preferably disposed in contact with the distal end of the cap boss 60. As will be recognized, the plug 72 will be operatively coupled to the cap 50 and cartridge body 38 in the aforementioned manner prior to filling the reservoir 40 with a concentrated fluid via the secondary opening 68 of the cap 50.

The application of downward pressure to the exposed distal end 77 of the plug 72 facilitates the movement thereof to its dispensing position. As the plug 72 is moved from the sealing position toward the dispensing position, the flared portion 78 is moved downwardly out of fluid tight engagement with the projection 47. In this manner, the flared portion 78 moves along the cartridge axis 48 out of fluid tight engagement with the projection 47. The plug neck 74 also moves downwardly relative to the cap boss 60, but remains in frictional engagement with the cap boss 60 when the plug 72 is in the dispensing position. In this manner, the plug 72 is held in engagement with the cap 50 to prevent the plug 72 from falling through the second opening 46. As the plug 72 moves from the sealing position toward the dispensing position, the plug flange 76 moves out of contact with the cap boss 60.

It is contemplated that the refill cartridge 36 may be sold separate from the bottle 12 and the pumping mechanism 22. In other words, a user may purchase the refill cartridge 36 to refill the bottle 12 when the fluid within the bottle 12 is empty. It is also contemplated that the refill cartridge 36 may be sold with the bottle 12, or with the pumping mechanism 22. When sold with the bottle 12, the cartridge 36 and bottle 12 may be used with an existing pumping mechanism 22. Conversely, when sold with a pumping mechanism 22, the refill cartridge 36 and pumping mechanism 22 will be used with an existing bottle 12. The refill cartridge 36 may also be sold with a new bottle 12 and pumping mechanism 22. In this manner, the bottle 12 may include fluid for dispensing by the pumping mechanism 22. When the fluid level within the bottle decreases to the point where bottle 12 is effectively empty, the fluid within the on-board refill cartridge 36 may be used to refill the bottle 12. When the refill cartridge 36 is provided with the new bottle 12, the abutted flanges 54, 45 which overlie the rim of the bottle 12 are secured to the rim by the pump attachment element 30 of the pumping mechanism 22. The tube 32 of the pumping mechanism 22 is extended through and is thus accommodated by the flow passage 84 of the plug 72 as described above.

The use of the refill cartridge 36, when sold with the new bottle 12 and pumping mechanism 22, is as follows. When the fluid level in the bottle 12 is sufficiently low, the pumping mechanism 22 is removed from the bottle 12 to provide access to the refill cartridge 36. In most cases, the fluid within the refill cartridge 36 contains a highly concentrated level of the fluid that was previously in the bottle 12. The refill cartridge 36 is removed from within the interior of the bottle 12 by grasping the abutted flanges 54, 45 which overlie the rim of the bottle 12. Thereafter, water or other diluting fluid may be filled into the bottle 12 prior to dispensing the fluid within the refill cartridge 36 into the bottle 12. Typically, if the fluid within the refill cartridge 36 is filled into the bottle 12 prior to filling a diluting fluid in the bottle 12, the concentrated fluid emptied into the bottle 12 will begin to bubble as the diluting fluid is filled into the bottle 12. Therefore, it may be desirable to fill the diluting fluid into the bottle 12 prior to filling the concentrated fluid from the refill cartridge 36 into the bottle 12. To this end, the bottle 12 may include a marking to indicate how much diluting fluid is required for use with the concentrated fluid.

After the diluting fluid is sufficiently filled within the bottle 12, the cartridge 36 is reinserted into the bottle 12 by passing it through the bottle opening and resting the abutted flanges 54, 45 upon the bottle rim which defines the bottle opening, as shown in FIG. 1. The concentrated fluid within the refill cartridge 36 may then be dispensed into the bottle 12. To dispense the fluid within the refill cartridge 36, the plug neck 74 is pushed by a user from the sealing position toward the dispensing position. More specifically, the distal end 77 is pushed by a user toward the cap base 56. In this regard, the fluid tight seal between the flared portion 78 and the projection 47 is broken, thereby allowing the fluid within the refill cartridge 36 to exit the cartridge reservoir 40 via the second opening 46 and into the bottle 12. After the fluid is dispensed into the bottle 12, the pumping mechanism 22 is reattached to the bottle 12. At this point, the refill cartridge 36 does not have to be disposed within the bottle 12, but rather can be removed in the aforementioned manner and discarded. After the pumping mechanism 22 is connected to the bottle 12, the user may then shake the bottle 12 to mix the highly concentrated fluid with the diluting fluid. Once the fluids are mixed, the spray bottle assembly 10 may be used to dispense the fluid.

Figure 14:
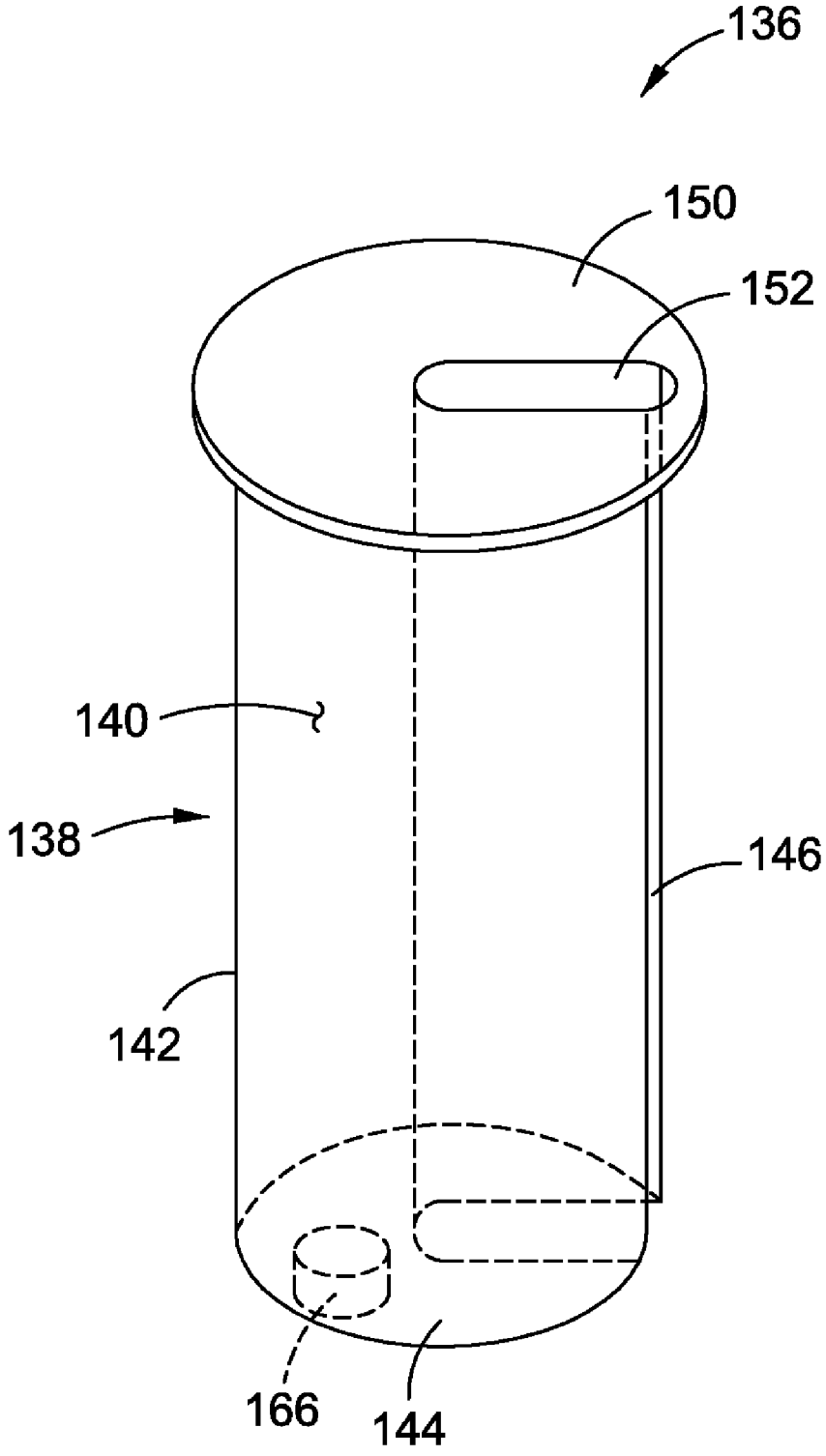
FIG. 14 is a top perspective view of an alternative embodiment of the refill cartridge.

Referring now to FIG. 14, there is shown a refill cartridge 136 constructed in accordance with an alternative embodiment of the present invention which may be substituted for the above-described refill cartridge 36. The refill cartridge 136 includes a cartridge body 138 defining a reservoir 140 configured to store fluid. In this manner, the cartridge body 138 is preferably formed of a fluid impermeable material, such as plastic or rubber. As shown in FIG. 14, the cartridge body 138 has a substantially cylindrical configuration, and includes a side wall 142, a bottom wall 144 which is integrally connected to one end of the side wall 142, and a top wall (not shown) which is integrally connected to the remaining end of the side wall 142. Formed in the side wall 142 of the cartridge body 138 is an elongate channel 146 which extends from the bottom wall 144 to the top wall. The channel 146 is used for reasons which will be described in more detail below.

It addition to the cartridge body 138, the refill cartridge 132 includes a cap 150 that is attached to the top wall of the cartridge body 138. The cap 150 is sized so as to include a peripheral portion which protrudes radially outward relative to the outer surface of the side wall 142 of the cartridge body 138. The cap 150 also includes an elongate slot 152 formed therein which communicates with the channel 146 in the manner shown in FIG. 14. Those of ordinary skill in the art will recognize that the cartridge body 138 may be formed so as not to include the top wall, with the cap 150 being integrally connected to the side wall 142 such that the slot 152 communicates with the channel 146 in the aforementioned manner.

As is further shown in FIG. 14, it is contemplated that the bottom wall 144 may include a ring-like projection 166 which extends therefrom and is offset from the center thereof. The projection 166 defines an opening that extends through the bottom wall 144 and fluidly communicates with the reservoir 140 of the cartridge body 138. In this regard, the refill cartridge 136 may be filled with the fluid via the opening of the projection 166, with such opening being sealed with a suitable plug once the reservoir 140 is filled with the fluid.

When sold with the bottle 12, the refill cartridge 136 resides within the reservoir 16 of the bottle 12, with the peripheral portion of the cap 150 which overhangs the cartridge body 138 resting on the rim of the bottle 12 in the same manner as the flange 45 of the above-described refill cartridge 36. The attachment of the pumping mechanism 22 to the bottle 12 effectively compresses the peripheral portion of the cap 150 between the pump attachment element 30 and the rim, thus securing the refill cartridge 136 to the bottle 12. At the same time, the tube 32 of the pumping mechanism 22 is accommodated by the channel 146 and the slot 152 within the cap 150, the tube 32 extending through the refill cartridge 136.

When the fluid level in the bottle 12 is sufficiently low, the pumping mechanism 22 is removed from the bottle 12 to provide access to the refill cartridge 136. The refill cartridge 136 is removed from within the interior of the bottle 12 by grasping the peripheral portion of the cap 150 which overlies the rim of the bottle 12. Thereafter, water or other diluting fluid may be filled into the bottle 12 prior to dispensing the fluid within the refill cartridge 136 into the bottle 12. After the diluting fluid is sufficiently filled within the bottle 12, the plug is removed from within the projection 166, with the contents of the refill cartridge 136 thereafter being poured into the diluting fluid within the bottle 12. After the concentrated fluid is dispensed into the bottle 12, the pumping mechanism 22 is reattached to the bottle 12. At this point, the refill cartridge 136 does not have to be disposed within the bottle 12, but rather can be discarded. After the pumping mechanism 22 is reattached to the bottle 12, the user may then shake the bottle 12 to mix the highly concentrated fluid with the diluting fluid. Once the fluids are mixed, the spray bottle assembly 10 may be used to dispense the fluid.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A refill assembly comprising:

a bottle defining an internal reservoir and an opening which communicates with the reservoir, the opening being defined by a rim of the bottle;

a pumping mechanism configured to be cooperatively engageable with the bottle; and a refill cartridge cooperatively engaged to the bottle, the refill cartridge including:

a cartridge body having a flange portion abutted against the rim, the cartridge body defining a cartridge reservoir having a concentrated chemical agent stored therein, the cartridge body including a tubular projection defining an opening which fluidly communicates with the cartridge reservoir;

a plug cooperatively engaged to the cartridge body and selectively movable from a sealing position to a dispensing position relative thereto, the movement of the plug from the sealing position to the dispensing position facilitating the flow of the chemical agent from the cartridge reservoir into the reservoir of the bottle; and a cap connected to the cartridge body and including a tubular boss defining a flow passage which fluidly communicates with the cartridge reservoir, the cartridge reservoir being collectively defined by the cartridge body, the plug and the cap;

wherein the plug is frictionally engaged to the boss and protrudes from the cap, and is further frictionally engaged to the projection of the cartridge body, the application of pressure to that portion of the plug protruding from the cap facilitating the movement thereof from the sealing position to the dispensing position, with the movement of the plug to the dispensing position facilitating the formation of a fluid flow path between the projection and a portion of the plug;

wherein the refill cartridge is configured to reside within the internal reservoir with the plug in the scaling position when the pumping mechanism is engaged with the bottle.

2. The refill assembly of claim 1 wherein the pumping mechanism is cooperatively engaged to the bottle in manner maintaining the flange portion of the cartridge body in abutting contact with the rim of the bottle.

3. The refill assembly of claim 2 wherein:

the pumping mechanism includes a nozzle and a fluid tube which is connected to the nozzle and advanced into the bottle reservoir; and the plug is tubular, with the fluid tube of the pumping mechanism passing therethrough.

4. The refill assembly of claim 1 wherein the plug is tubular and includes a neck which is frictionally engaged to and creates a fluid tight seal with the boss when the plug is in both the sealing and dispensing positions, and a flared portion which is frictionally engaged to and creates a fluid tight seal with the projection when the plug is in the sealing position, but is disposed in spaced relation to the projection upon the movement of the plug to the dispensing position such that the fluid flow path is defined between the plug and the cartridge body.

5. The refill assembly of claim 4 wherein:

the pumping mechanism includes a nozzle and a fluid tube which is connected to the nozzle is cooperatively engaged to the bottle in manner maintaining the flange portion of the cartridge body in abutting contact with the rim of the bottle; and the fluid tube of the pumping mechanism extends through the tubular plug into the reservoir of the bottle.

6. The refill assembly of claim 4 wherein the boss of the cap includes a tapered inner surface which defines the flow passage thereof.

7. A refill assembly comprising:

a bottle defining an internal reservoir and an opening which communicates with the reservoir, the opening being defined by a rim of the bottle; and a refill cartridge cooperatively engaged to the bottle and at least partially residing within the reservoir thereof, the refill cartridge including:

a cartridge body including a tubular projection defining an opening, and a flange portion disposable in abutted relation against the rim;

a cap connected to the cartridge body, the cap including a tubular boss defining a flow passage which fluidly communicates with the cartridge reservoir; and a plug cooperatively engaged to the cartridge body and selectively movable from a sealing position to a dispensing position relative thereto, a radially extending flange which is abutted against the boss when the plug is in the sealing position:

the cartridge body, the plug and the cap collectively defining a cartridge reservoir for storing a concentrated chemical agent therein;

the movement of the plug from the sealing position to the dispensing position facilitating the flow of the chemical agent from the cartridge reservoir into the reservoir of the bottle.

8. A refill assembly configured for use with a lid, the refill assembly comprising:

a containment vessel defining an internal reservoir, the containment vessel being engageable with the lid to enclose the internal reservoir;

a refill cartridge cooperatively engaged to the containment vessel and including a cartridge body defining a cartridge reservoir having a concentrated chemical agent stored therein, the cartridge body including a flange portion which is sized and configured to be placeable upon a portion of the containment vessel, and a tubular projection defining an opening which fluidly communicates with the cartridge reservoir;

a plug cooperatively engaged to the cartridge body and selectively movable from a scaling position to a dispensing position relative thereto, the movement of the plug from the sealing position to the dispensing position facilitating the flow of the chemical agent from the cartridge reservoir; and a cap connected to the cartridge body, and including a tubular boss defining a flow passage which fluidly communicates with the cartridge reservoir, the cartridge reservoir being collectively defined by the cartridge body, the plug and the cap;

wherein the refill cartridge is configured to reside within the internal reservoir with the plug in the sealing position when the lid is engaged with the containment vessel;

wherein the plug is frictionally engaged to the boss and protrudes from the cap, and is further frictionally engaged to the projection of the cartridge body, the application of pressure to that portion of the plug protruding from the cap facilitating the movement thereof from the sealing position to the dispensing position, with the movement of the plug to the dispensing position facilitating the formation of a fluid flow path between the projection and a portion of the plug.

9. The refill assembly of claim 8 wherein the plug is tubular and includes a neck which is frictionally engaged to and creates a fluid tight seal with the boss when the plug is in both the sealing and dispensing positions, and a flared portion which is frictionally engaged to and creates a fluid tight seal with the projection when the plug is in the scaling position, but is disposed in spaced relation to the projection upon the movement of the plug to the dispensing position such that the fluid flow path is defined between the plug and the cartridge body.

10. The refill assembly of claim 9 wherein the boss of the cap includes a tapered inner surface which defines the flow passage thereof.

11. A refill assembly comprising:

a containment vessel; and a refill cartridge cooperatively engaged to the containment vessel and including a cartridge body including a flange portion which is sized and configured to be placeable upon a portion of the containment vessel, the cartridge body defining a cartridge reservoir having a concentrated chemical agent stored therein, the refill cartridge further including:

a cap connected to the cartridge body, the cap including a tubular boss defining a flow passage which fluidly communicates with the cartridge reservoir, and a plug cooperatively engaged to the cartridge body and selectively movable from a sealing position to a dispensing position relative thereto, the plug including a radially extending flange which is abutted against the boss when the plug is in the sealing position;

the cartridge body, the plug and the cap collectively defining a cartridge reservoir for storing a concentrated chemical agent therein;

the movement of the plug from the sealing position to the dispensing position facilitating the flow of the chemical agent from the cartridge reservoir.

* * * * *